US010644467B2

(12) United States Patent
Sauer-Oberschelp

(10) Patent No.: US 10,644,467 B2
(45) Date of Patent: May 5, 2020

(54) COAXIAL PLUG CONNECTOR FOR MOUNTING ON CIRCUIT BOARDS

(71) Applicant: Automotive Lighting Reutlingen GmbH, Reutlingen (DE)

(72) Inventor: Martina Sauer-Oberschelp, Kirchheim u. T. (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 16/386,797

(22) Filed: Apr. 17, 2019

(65) Prior Publication Data

US 2019/0326713 A1 Oct. 24, 2019

(30) Foreign Application Priority Data

Apr. 19, 2018 (DE) ..... 10 2018 109 364

(51) Int. Cl.

| | |
|---|---|
| ***H01R 24/40*** | (2011.01) |
| ***H01R 12/70*** | (2011.01) |
| *H01R 9/05* | (2006.01) |
| *H01R 13/6582* | (2011.01) |
| *H01R 24/50* | (2011.01) |

(52) U.S. Cl.
CPC ..... *H01R 24/40* (2013.01); *H01R 12/707* (2013.01); *H01R 9/0515* (2013.01); *H01R 13/6582* (2013.01); *H01R 24/50* (2013.01)

(58) Field of Classification Search
CPC ... H01R 9/0515; H01R 24/50; H01R 13/6582
See application file for complete search history.

(56) References Cited

U.S. PATENT DOCUMENTS

| | | | | |
|---|---|---|---|---|
| 3,662,318 A * | 5/1972 | Decuyper | H01P 5/085 | 439/63 |
| 5,438,690 A * | 8/1995 | Tsukuda | H04B 1/10 | 455/180.4 |
| 5,532,659 A * | 7/1996 | Dodart | H01R 9/0515 | 333/260 |
| 6,079,986 A | 6/2000 | Beshears | | |
| 6,386,888 B1 * | 5/2002 | Skopic | H01R 24/50 | 439/581 |

(Continued)

FOREIGN PATENT DOCUMENTS

| | | |
|---|---|---|
| DE | 3608477 A1 | 9/1987 |
| DE | 69900418 T2 | 9/2002 |

(Continued)

OTHER PUBLICATIONS

Communication dated Aug. 23, 2019 transmitting the European Search Report dated Aug. 14, 2019 for European Patent Application No. 19166990.2.

(Continued)

*Primary Examiner* — Tho D Ta
(74) *Attorney, Agent, or Firm* — Howard & Howard Attorneys PLLC

(57) ABSTRACT

A coaxial connector for mounting on circuit boards or the like with a socket for accommodating a coaxial cable end and contacts for mounting the connector on the circuit board, whereby the socket is combined with a metal flange, which can be connected to an external electromagnetic compatible shielding device.

5 Claims, 1 Drawing Sheet

(56) References Cited

U.S. PATENT DOCUMENTS

| | | | | |
|---|---|---|---|---|
| 6,457,979 | B1 * | 10/2002 | Dove | H01R 9/0515 439/63 |
| 7,114,956 | B2 | 10/2006 | Kreitzer et al. | |
| 10,148,027 | B2 * | 12/2018 | Matsumoto | H01P 5/085 |
| 10,263,371 | B2 * | 4/2019 | Dejardin | H01R 12/57 |
| 2004/0121625 | A1 * | 6/2004 | Togashi | H01R 24/50 439/63 |
| 2007/0054510 | A1 * | 3/2007 | Price | H01R 24/50 439/63 |
| 2008/0102654 | A1 * | 5/2008 | Kari | H01R 24/50 439/63 |
| 2019/0239340 | A1 * | 8/2019 | Trulli | G06F 1/182 |

FOREIGN PATENT DOCUMENTS

| | | | |
|---|---|---|---|
| DE | 102008024300 | A1 | 9/2009 |
| EP | 0793299 | A1 | 9/1997 |
| JP | S56147379 | A | 11/1981 |
| WO | 2012155797 | A1 | 11/2012 |

OTHER PUBLICATIONS

Search Report for German Patent Application No. 10 2018 109 364.0 dated Dec. 11, 2018.

* cited by examiner

COAXIAL PLUG CONNECTOR FOR MOUNTING ON CIRCUIT BOARDS

CROSS-REFERENCE TO RELATED APPLICATIONS

The present application claims priority to and all the benefits of German Patent Application No. 10 2018 109 364.0, filed on Apr. 19, 2018, which is hereby expressly incorporated herein by reference in its entirety.

BACKGROUND OF THE INVENTION

1. Field of the Invention

The invention relates to a coaxial plug connector for mounting on circuit boards or the like, with a socket for receiving a coaxial cable end and contacts for mounting the plug connector on the circuit board.

2. Description of the Related Art

Such plug connectors are known in various embodiments. Smaller coaxial plug connectors in surface mount technology implementations are thus soldered directly to the surface of the circuit boards. In addition, through hole technology implementations are known, particularly for larger plug connectors. Known plug connectors have no shielding, however, so that the electromagnetic compatibility characteristics of the assembly on the circuit board are diminished by their use.

The object of the present invention is to correct this problem.

The task is accomplished by a coaxial plug connector for mounting on circuit boards or the like with a socket for receiving a coaxial cable end and contacts for mounting the connector on the circuit board, characterized in that the socket is connected to a metal flange, which can be connected to an external electromagnetic compatible shielding device.

Due to the additional metal flange, the plug connector can be connected to a shielding device, generally arranged on the circuit board itself or next to it, a shielding plate for example, so that the plug connector no longer represents an electromagnetic compatible gap in the system as a whole.

In addition, the metal flange increases the stability of the plug connector, so that in particular side forces, which occur during connection, can be better absorbed.

In addition, the coaxial plug connector can have a mounting flange, on which the contacts are arranged. This mounting flange offers a relatively large contact area on the circuit board and thus likewise increases the mechanical stability of the plug connector. The metal flange and the mounting flange are preferably electrically conducting connected to one another so that an optimal shielding of the plug connector can be achieved.

The contacts of the coaxial plug connector can be soldered to the circuit board in a manner known per se. In addition to implementation as surface mount technology plug connectors, the plug connectors could however also be implemented as through hole technology plug connectors, with contact pins passing through the circuit board that are soldered to the reverse side of the circuit board.

In a preferred embodiment, the contacts are designed as pin-in-paste legs, which allows time and cost savings in mounting the connector. In a first reflow pass, the plug connector is soldered on the upper side of the circuit board, and in a second reflow pass to the underside. Due to the mounting flange, the connector can undergo, with surface mount technology soldering, a second overhead reflow soldering pass, without the plug connector having to be previously glued to the circuit board.

Other advantages occur if the legs are positioned in the area of the outer circumference of the mounting flange. The soldering joints can thereby be automatically optically checked after assembly (AOI).

In addition, the coaxial plug connector can have an angled internal conductor, whereby the angled end of the internal conductor can be soldered to the circuit board, whereby the electrical connection between the internal conductor and other circuit board components can be created.

It is therefore advantageous if the metal flange and the mounting flange have a recess, through which a solder meniscus of the angled end of the internal conductor can be seen from the outside. In this manner, even the soldering joint of the internal conductor can be checked by using AOI.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
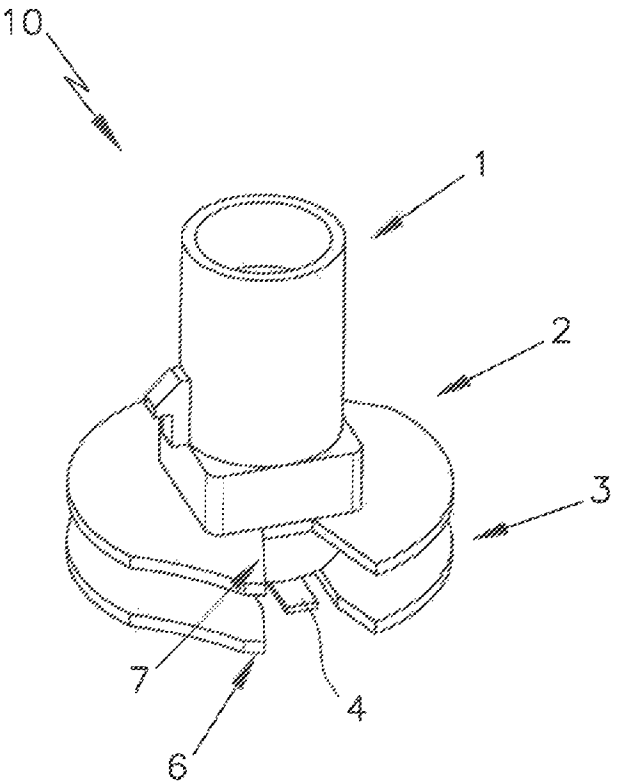
FIG. 1 is a perspective view of a coaxial plug connector.

According to FIG. 1, the coaxial plug connector 10 shows a socket 1 for the end of a coaxial cable (not shown). The socket 1 sits on a metal flange 2, which can be connected with a shield, not shown here. A mounting flange 3 is positioned in parallel with the metal flange 2, which is connected metallically to the metal flange 2. Optimal shielding of the connector 10 can thereby be achieved.

Both flanges 2, 3 respectively have a recess 6, 7, which allows viewing of an angled end of an internal conductor 4, which is also soldered to the surface of a circuit board, not shown here. The recesses 6, 7 allow the solder meniscus of the inner conductor 4 to be checked with an AOI method.

Figure 2:
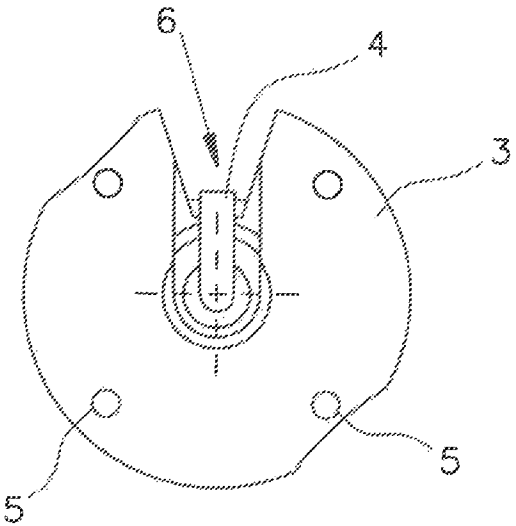
FIG. 2 is a view from below of the coaxial plug connector of FIG. 1.

The plug connector 10 is additionally soldered to the circuit board surface with four contact legs 5, which are arranged on the underside of the mounting flange 3, as elucidated in FIG. 2. The legs 5 are designed as pin-in-paste legs. They are pushed into soldering paste applied to the circuit board. Thereafter the circuit board is warmed and cooled, whereby the solder connection forms between the legs 5 and the circuit board.

The legs 5 are positioned at the outer circumference of the mounting flange 3, so that the soldering joints of the legs 5 can also be checked by an AOI method. For two of the legs 5, this check will also be made easier by the flattening of the circumference of the mounting flange 3.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A coaxial plug connector for mounting on circuit boards with a socket for receiving a coaxial cable end and contacts for mounting the plug connector on a circuit board, wherein the socket is connected to a metal flange, which can be connected to an external electromagnetic compatible shielding device, said connector further including a mounting flange on which the contacts are arranged and further includes an angled internal conductor, whereby an angled end of the internal conductor can be soldered to the circuit board and whereby the metal flange and the mounting flange have a recess through which a solder meniscus of the angled end of an internal conductor can be seen from outside the connector.

2. The coaxial plug connector as set forth in claim 1, wherein the contacts can be soldered to the circuit board.

3. The coaxial plug connector as set forth in claim 1 wherein the metal flange and the mounting flange are electrically conductively connected to one another.

4. The coaxial plug connector as set forth in claim 1, wherein the contacts are designed as pin-in-paste legs.

5. The coaxial plug connector as set forth in claim 3, wherein the legs are arranged in the area of an outer circumference of the mounting flange.

* * * * *